US005363984A

United States Patent [19]

Laird, III

[11] Patent Number: 5,363,984

[45] Date of Patent: Nov. 15, 1994

[54] DISPLAY DEVICE HAVING AN ARTICLE DISPENSER THEREIN

[75] Inventor: Jesse D. Laird, III, Mapleton Depot, Pa.

[73] Assignee: Gldrj Company, Georgetown,

[21] Appl. No.: 95,386

[22] Filed: Jul. 23, 1993

[51] Int. Cl.[5] ..... A24F 15/04

[52] U.S. Cl. ..... 221/24; 221/266; 446/71

[58] Field of Search ..... 221/24, 264, 266, 282, 221/265; 222/78; 446/71, 72, 73

[56] References Cited

U.S. PATENT DOCUMENTS

| | | | |
|---|---|---|---|
| D. 165,809 | 1/1952 | Wheeler | D52/3 |
| 269,764 | 12/1882 | Whitelaw | 446/71 |
| 1,700,541 | 1/1929 | Mills | 221/200 |
| 2,083,597 | 6/1937 | Edelman | 446/71 |
| 3,077,254 | 2/1963 | Goldfarb | 194/294 |
| 3,256,634 | 6/1966 | Mace | 446/71 |
| 4,733,803 | 3/1988 | Sisson et al. | 221/264 |
| 5,004,122 | 4/1991 | Poynter | 221/266 |

*Primary Examiner*—Kenneth W. Noland

*Attorney, Agent, or Firm*—Shlesinger, Arkwright & Garvey

[57] ABSTRACT

Article dispensing display device includes a picture frame and an article-holding reservoir disposed within the picture frame. An article dispensing chute is associated with the picture frame for dispensing articles from the reservoir, and is controlled by an article-metering device configured to dispense one or more articles at a time.

10 Claims, 2 Drawing Sheets

DISPLAY DEVICE HAVING AN ARTICLE DISPENSER THEREIN

FIELD OF THE INVENTION

This invention relates to a display device having an article dispenser associated therewith, for dispensing objects from the display device.

BACKGROUND OF THE INVENTION

There is a demand for display devices which are decorative or serve to both advertise and decorate.

Display devices which capture the viewer's attention and, preferably, command viewer interaction, are highly sought after in the marketplace.

There are known devices which serve as article dispensers and display means.

U.S. Pat. No. 5,004,122 to Poynter discloses an article dispensing package which includes a backing sheet and a blister piece combined to simulate a gum ball vending machine. A molded, irregularly formed blister piece retains a number of gum balls and simulates a conventional gum ball machine. A rotatable knob dispenses individual gum balls from the pointer display package.

U.S. Pat. No. 3,256,634 to Mace discloses an animated dispensing book package, by which a reader of the book may operate a dispenser actuator for ejecting an object, for example a simulated golden egg from an illustration of a goose accompanying a short story such as "The Goose That Laid the Golden Egg."

U.S. Pat. No. 3,077,254 to Goldfarb discloses a toy gum ball machine into which a coin must be deposited in order for a user to be able to actuate a gum ball dispensing valve. The dispensed gum ball must move along a tortuous passage before exiting the machine. Preferably, different exits having different score values associated therewith, are provided to heighten the amusement value of the toy.

Although the above described devices undoubtedly work, there is a need for a display device having an article dispenser which is relatively uncomplicated to manufacture and to use, and which avoids the drawbacks of the complex prior art dispensers.

OBJECTS AND SUMMARY OF THE INVENTION

It is therefore an object of the invention to provide a display device having an article dispenser therein which avoids the drawbacks of prior art device.

It is another object of the invention to provide a display device having an article dispenser therein that is easy to manufacture.

It is yet another object of the invention to provide an article dispensing display device which has enhanced reliability owing to its relatively few moving parts.

It is yet another object of the invention to provide an article dispensing display device which is suitable for use by both adults and children.

It is yet a still further object of the invention to provide an article dispensing display device which accurately dispenses objects.

It is a still further object of the invention to provide an article dispensing display device which accurately dispenses an object even when operated by a first-time user.

It is yet another object of the invention to provide an article dispensing display device which can be operated by users having arthritis and other physically challenged users.

It is a still further object of the invention to provide an article dispensing display device which is environmentally friendly, owing to its being reusable and refillable.

These and other objects of the invention, which will become apparent by reading the detailed description of my invention set forth below, are achieved by my present invention which includes an article dispensing display device having an article-holding reservoir disposed substantially within the display device, an article dispensing chute associated with said display device, and an article metering device disposed between the article holding reservoir and the article dispensing chute.

DETAILED DESCRIPTION OF THE INVENTION

Figure 1:
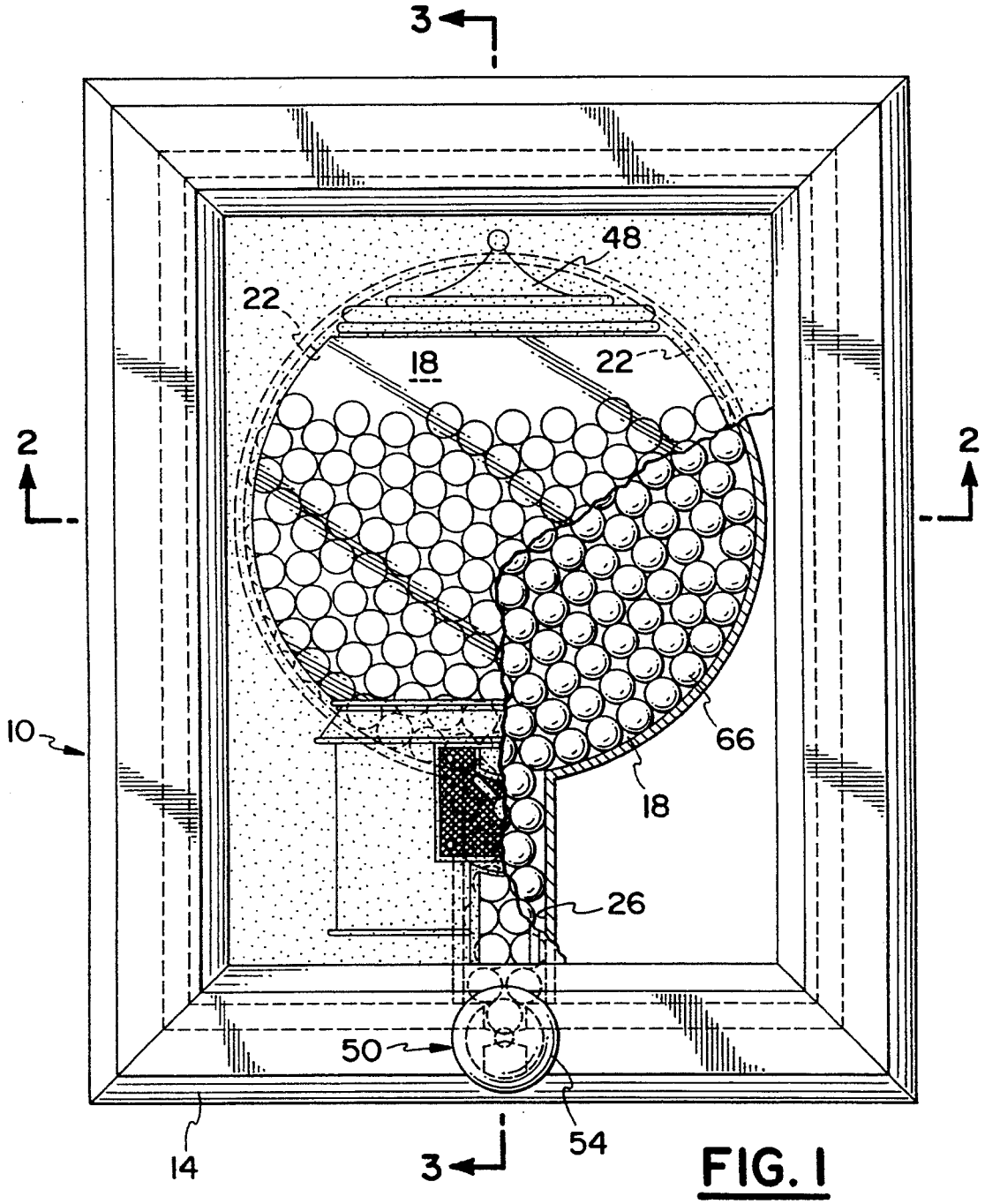
FIG. 1 is a front elevational view of a first preferred embodiment of an article dispensing display device according to my invention, shown partially filled with articles to be dispensed.
Figure 2:
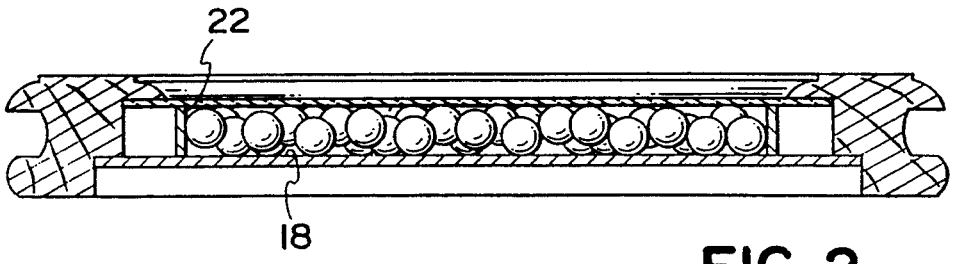
FIG. 2 is a cross-sectional view of the preferred embodiment of FIG. 1, taken along line 2—2.

The invention will now be described with specificity.

Turning first to FIGS. 1–4, a first preferred embodiment of an article dispensing display device 10 according to my invention is illustrated therein.

Article dispensing display device 10 includes, for example, a picture frame or other substantially flat member 14 such as would be typically mounted on a wall. An article holding reservoir 18 is disposed substantially within the confines of picture frame 14, and is bounded, in part, by a wall 22, illustrated as being partially curved in this first preferred embodiment.

Reservoir 18 includes an exit passage 26 extending from and "fluidly" connected with the main part of reservoir 18.

Figure 3:
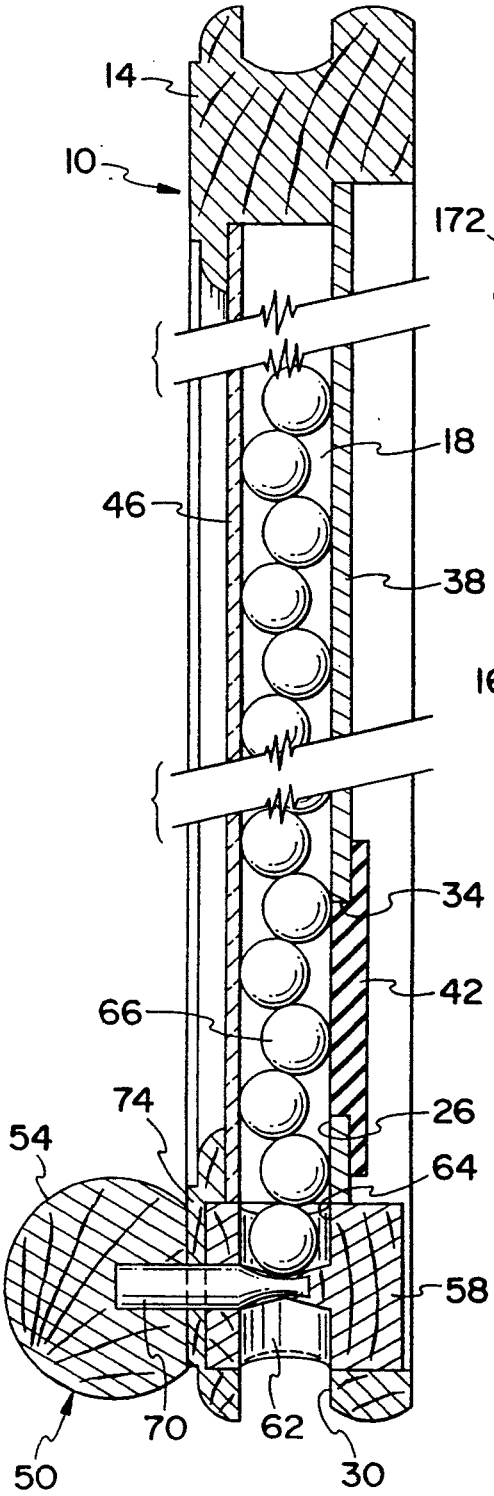
FIG. 3 is a cross-sectional view of the preferred embodiment of my invention shown in FIG. 1, taken along line 3—3.

An article dispensing chute 30 is preferably defined in picture frame 14 and opens downwardly as viewed in FIG. 3, for example.

A refill aperture 34 extends through a rear wall 38 and may be kept normally closed by a plug 42.

A front wall 46, together with rear wall 38 and curved wall 22 jointly define the basic volume of reservoir 18. Conveniently, front wall 46 can be provided with a decoration or other design 48 on one or both of the front or rear surfaces thereof. An exemplary design 48 is illustrated herein as a simulated gum ball machine.

A dispenser 50 controls the dispensing of objects from exit passage 26 and, hence, reservoir 18, through chute 30.

A control knob 54 is operatively associated with dispenser 50 so that a user can easily rotate a meter 58 relative to picture frame 14. Meter 58 includes one or more recesses 62, which preferably extend substantially in line with exit passage 26 and chute 30. Recesses 62 are sized to receive at least one article 66, for dispensing article 66 in a controlled fashion.

A connector 70 extends through a retaining wall 74 of picture frame 14 and joins control knob 54 to meter 58. By attaching connector 70 to both control knob 54 and meter 58, retaining wall 74 accurately locates and retains meter 58 in place.

Figure 5:
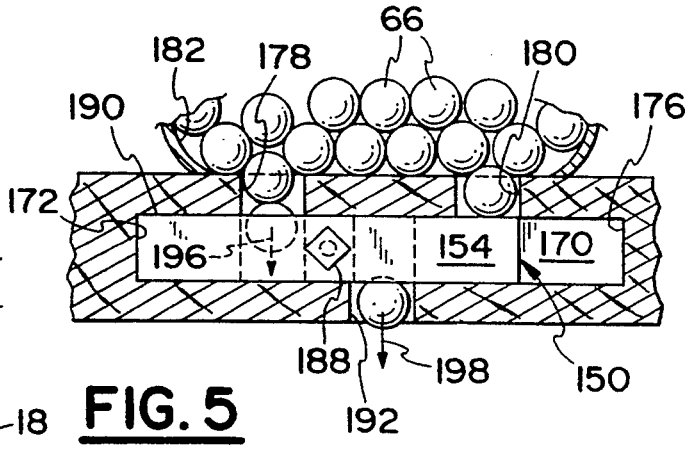
FIG. 5 is a partial sectional view of another preferred embodiment of the article dispensing display device according to my invention, showing another article dispenser according to my invention.
Figure 6:
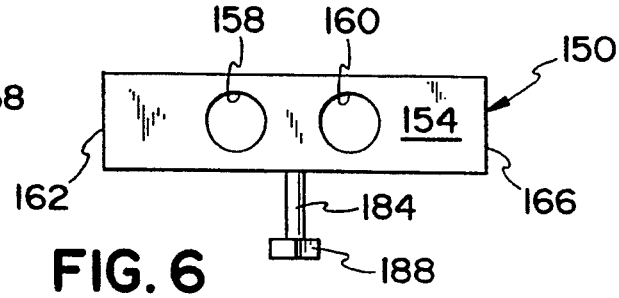
FIG. 6 is a somewhat schematic, top plan view of the article dispenser of FIG. 5.

Turning to FIGS. 5 and 6, a further preferred embodiment of a dispenser 150 for use with my article dispensing display device 10 according to the invention is illustrated.

Dispenser 150 includes a meter 154 having a left throughhole 158 and a right throughhole 160. Meter 154 has a left face 162 and a corresponding right face 166.

A chamber 170 is defined in frame 14 and receives meter 154. Chamber 170 includes a left wall 172 and a right wall 176, each of which are configured for abutting left face 162 and right face 166, respectively.

A left exit passage 178 and a right exit passage 180 each communicate with an article retaining reservoir 182.

An extension 184 protrudes from meter 154 and connects a handle or knob 188 thereto. Preferably, a top surface 190 defined on meter 154 is substantially coplanar with the openings of left exit passage 178 and right exit passage 180 for blocking passages 178 and 180 at predetermined portions of the travel of meter 154. A chute 192 opens downwardly, as viewed in the drawings, from chamber 170.

OPERATION

In use, article dispensing display device 10 according to the invention is attached to a wall, for example, by conventional fasteners.

Article dispenser 10 is oriented so that chute 30 opens downwardly as viewed in FIGS. 1–4.

When article 66, such as a toy, gum ball, other candy and food items, or other novelty devices, is to be dispensed, the user rotates control knob 54 relative to picture frame 14. In the case of meter 58 having two opposed recesses 62 and 64, the user rotates control knob 54 substantially through about 180°.

Figure 4:
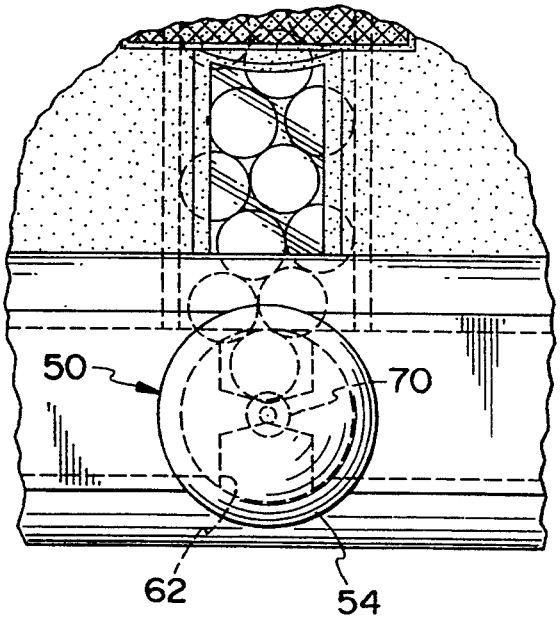
FIG. 4 is a partial sectional view of a portion of the preferred embodiment of the article dispensing display device of FIG. 1, on an enlarged scale.

Thus, article 66 which had been received in recess 64 is dropped through chute 30 when recess 64 is rotated to take the place of recess 62, such as illustrated in FIGS. 1, 3, and 4, showing the invention just prior to rotation of control knob 54. During rotation of control knob 54, the configuration of meter 58 and recesses 62 and 64 provide for the dispensing of a single article 66.

After meter 58 has been rotated through about 180°, previously emptied recess 62 will substantially align with exit passage 26, by which an additional article 66 will enter into now upwardly opening recess 62, owing to the force of gravity.

When some or all of articles 66 have been dispensed in that fashion, reservoir 18 can be refilled by removing plug 42 from rear wall 38 and inserting article 66 into reservoir 18. Preferably, plug 42 is located in communication with exit passage 26 so that plug 42 is normally hidden from view when reservoir 18 is substantially filled with articles 66.

It will be understood that plug 42 could be located at any other position within the confines of article dispensing display device 10 that communicates with reservoir 18. For example, curved wall 22 could be eliminated and plug 42 could be placed in an aperture extending through rear wall 38 that connects with an article dispensing exit passage or a portion of an article retaining reservoir. Needless to say, first-time users will dispose one or more articles 66 depending on the number of times they rotate control knob 54.

Use of the dispenser 150 according to the preferred embodiment shown in FIGS. 5–6 will now be explained.

Dispenser 150 is particularly suited for use by first-time users of article dispensing display device 10 who are unfamiliar with my invention, as users need only to slide meter 154 in just one direction (i.e., to the left or to the right as viewed in FIG. 5) in order to dispense one of articles 66.

As illustrated, FIG. 5 shows the instant in which meter 154 has been slid to the left and an article 66 is entering left throughhole 158 in the direction of arrow 196. At substantially the same time, an article 66 is exiting chute 192 in the direction of arrow 198.

Article 66 has entered chamber 170 owing to left face 162 of meter 154 having abutted left wall of chamber 170, whereby left throughhole 158 has been substantially aligned with left exit passage 178 of reservoir 182. Meter 154 is configured so that right throughhole 160 concurrently aligns with chute 192.

Accordingly, in order to dispense the next article 166 which has just entered left throughhole 158, the user simply pushes handle 188 to the right as viewed in FIGS. 5 and 6.

As meter 154 is slid to the right, top surface 190 blocks left exit passage 178. When right face 166 has contacted right wall 176, right throughhole 160 will be substantially aligned with right exit passage 180, whereby a next article 66 passes therethrough and enters right throughhole 160.

The preferred embodiment of the dispenser 150 shown in FIGS. 5–6 is particularly suited for first-time users, as the abutting walls of chamber 170 with the respective faces of 154 provide positive feedback to the user that one complete cycle has been made, especially as one of articles 66 is dispensed at the same time. Dispenser 150 is also suitable for those with severe arthritis and others who are physically challenged as a user simply needs to be able to slide or push handle 188 in one direction.

It is expected that all conventional materials will be used to make the article dispensing display device according to my invention.

For example, it is contemplated that one or more of the walls be made of materials such as MARLITE TM or MASONITE TM, other particle boards, and glass, plastic, and appropriate metals.

The frame is preferably made of wood, suitable for a business person's office, although it is expected that synthetic materials, metal, stone, such as marble and limestone, and the like, will be used. The frame will be any shape, such as oval, triangular, rectangular, polygonal, irregularly contoured, and may have a shape suggestive of an outline of an article. The picture frame may have an anthropomorphic shape, such as an animal, plant, or a cartoon character.

It is likewise contemplated that small toys, candies, marbles, other amusement devices, coins, and similar "prizes" will be dispensed.

Each of my metering devices will be provided with additional recesses and throughholes, as required, to dispense multiple objects at a time, as desired.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. An article dispensing display device, comprising:

a) a picture frame;

b) an article-holding reservoir disposed substantially within said picture frame;

c) an article-dispensing chute associated with said picture frame; and d) an article-metering device disposed between said article-holding reservoir and said article dispensing chute wherein the substantially flat configuration of the article dispensing display device is substantially contained within the picture frame.

2. An article dispensing display device as defined in claim 1, wherein:

a) said article-holding reservoir is substantially flat.

3. An article dispensing display device as defined in claim 1, wherein:

a) said picture frame is substantially rectangular.

4. An article dispensing display device as defined in claim 1, wherein:

a) said article-metering device is substantially disposed in said frame.

5. An article dispensing display device as defined in claim 1, wherein:

a) said article-metering device is configured as a slide having an article receiving recess defined therein.

6. An article dispensing display device, comprising:

a) a substantially flat member, said substantially flat member including a picture frame;

b) an article holding reservoir disposed substantially within said substantially flat member;

c) an article dispensing chute associated with said substantially flat member; and d) an article metering device disposed between said article holding reservoir and said article dispensing chute wherein the substantially flat configuration of the article dispensing display device is substantially contained with the picture frame.

7. An article dispensing display device as defined in claim 6, wherein:

a) said article-holding reservoir is substantially flat.

8. An article dispensing display device as defined in claim 6, wherein:

a) said article-metering device is substantially disposed in said picture frame.

9. An article dispensing display device as defined in claim 6, wherein:

a) said article-metering device is configured as a slide having an article receiving recess defined therein.

10. An article dispensing display device as defined in claim 6, wherein:

a) said article-metering device is configured for metering one article at a time.

* * * * *